US008590772B2

(12) United States Patent
Delause et al.

(10) Patent No.: US 8,590,772 B2
(45) Date of Patent: Nov. 26, 2013

(54) PACKING CASE WITH CENTERING TAB, SET OF CUTOUTS AND METHOD FOR CREATING SUCH A CASE

(75) Inventors: Bernard Delause, Epinal (FR); Gerard Mathieu, Cergy (FR)

(73) Assignee: Otor (FR)

( * ) Notice: Subject to any disclaimer, the term of this patent is extended or adjusted under 35 U.S.C. 154(b) by 481 days.

(21) Appl. No.: 12/810,582

(22) PCT Filed: Dec. 22, 2008

(86) PCT No.: PCT/FR2008/001813

§ 371 (c)(1),
(2), (4) Date: Sep. 7, 2010

(87) PCT Pub. No.: WO2009/106740

PCT Pub. Date: Sep. 3, 2009

(65) Prior Publication Data

US 2011/0000957 A1 Jan. 6, 2011

(30) Foreign Application Priority Data

Dec. 26, 2007 (FR) ..... 07 09139

(51) Int. Cl.
*B65D 43/00* (2006.01)
*B31B 17/00* (2006.01)
*B31B 1/62* (2006.01)

(52) U.S. Cl.
USPC ..... 229/125.01; 493/84; 493/150

(58) Field of Classification Search
USPC ..... 229/125.01, 141; 493/84, 150; 206/501
See application file for complete search history.

(56) References Cited

U.S. PATENT DOCUMENTS

| | | | | |
|---|---|---|---|---|
| 4,373,659 | A * | 2/1983 | Cornell et al. | 206/511 |
| 5,390,847 | A * | 2/1995 | Young | 229/122.21 |
| 6,234,385 | B1 | 5/2001 | Espinoza et al. | |
| 6,354,487 | B1 * | 3/2002 | Muise, Jr. | 229/125.28 |

FOREIGN PATENT DOCUMENTS

| | | | |
|---|---|---|---|
| DE | 29902192 | U1 | 4/1999 |
| DE | 19824268 | A1 | 12/1999 |
| FR | 2311717 | A | 12/1976 |
| FR | 2761341 | A | 10/1998 |
| FR | 2800039 | A | 4/2001 |

OTHER PUBLICATIONS

International Search Report, Dec. 2009.

* cited by examiner

*Primary Examiner* — Gary Elkins
*Assistant Examiner* — Christopher Demeree
(74) *Attorney, Agent, or Firm* — Banner & Witcoff, Ltd.

(57) ABSTRACT

This is a packing case (40), a set of cutouts and a method of obtaining a case comprising a bottom that forms a half-case (41) obtained from a first cutout and a lid formed from a second cutout, the underside of the bottom being equipped with recesses (19, 85, 108, 109, 110, 111) and the lid comprising at least two tabs (33, 43, 54, 55, 56, 57, 73, 74, 75, 88) bonded onto its top face, in vertical alignment with the recesses of complementary shape. The lid comprises a central panel (20, 37) equipped on its sides with four lateral panels (21, 22, 23, 24, 77, 79, 81) of which two (21, 23) are equipped with end flaps (27, 28, 29, 30) said tabs each being connected to one of said end flaps.

17 Claims, 8 Drawing Sheets

22
20
23
21
24
40
41

35
36
33
35
21
28
29

25
22
33
26
33
35
24
21
28
28

33
40
24
28

PACKING CASE WITH CENTERING TAB, SET OF CUTOUTS AND METHOD FOR CREATING SUCH A CASE

The present invention relates to a case comprising a bottom forming a half case and a lid, the underside of the bottom being provided with recesses and the lid comprising tabs on its top surface, in line with the recesses, and of a complementary shape.

It also relates to a set of cutouts for constructing such a case and to a method of manufacture using said set.

It finds a particularly important, although non-exclusive application in the field of boxes that can be stacked on pallets, which may have a tendency to slip relative to one another while they are being handled or during transport.

Box centering systems that avoid box slippage are already known, these employing lateral lugs which collaborate with orifices positioned on or near the edge corners.

Such systems are weak and unable to withstand repeated handling.

Packagings the lid of which is formed of flaps some of which are of a shape that complements that of notches made in the bottom, likewise formed of flaps, so that these can nest together and thus provide lateral immobilization are also known (FR-A-2 311 717).

Aside from the fact that such an embodiment entails a cut-out blank shape with two sets of flaps, it is not suitable for low basis weights and does not always allow perfectly vertical stacking, because of the discrepancies that may exist when the box is being made up.

A box with a lid with tabs stuck down onto the top surface thereof is also known. The tabs are cut out and folded backward, thus exhibiting a double fold line.

Although such a box provides good centering and excellent immobilization, it is not always easy to make up because of this special feature associated with the turning back of the tab.

It is an aim of the present invention to provide a case, a set of cutouts and a making-up method which are better able than those known previously to meet the practical requirements, particularly because, on the one hand, it proposes that the cases be centered on one another, allowing the boxes to be stacked perfectly and, on the other hand, because it allows the cases to be formed in a simple and inexpensive way.

With the invention it will therefore be possible to avoid any slippage of the packagings when they are stacked on top of one another when placed on pallets and thus allow the use of light basis weight board, and in so doing avoiding the use of palletizing accessories that are costly and require extra handling.

To this end, the present invention notably proposes a packing case comprising a bottom forming a half-case obtained from a first cutout and a lid formed by a second cutout, the underside of the bottom being equipped with recesses and the lid comprising at least two tabs which are stuck to the top surface thereof, in line with the recesses of complementary shape, characterized in that the lid comprises a central panel equipped on its sides with four lateral panels two of which are equipped with end flaps, said tabs each being connected to one of said end flaps.

In some advantageous embodiments, recourse is further had to one and/or another of the following arrangements:

- the central panel is rectangular, the lateral panels comprising two first opposite lateral panels which are connected to said central panel by first fold lines with, at each end, said end flaps forming reinforced corners which are connected to said first panels by third fold lines, the tabs themselves being connected respectively to the top edge of said corresponding flaps by fourth fold lines, and two second opposite lateral panels which are connected to said central panel by second fold lines, without flaps;
- the central panel comprises slots through which the tabs can pass in the second fold lines between the central panel and the second lateral panels, said first lateral panels being folded over downward to collaborate with the lateral faces of the half-case opposite, said flaps being folded down onto the corresponding corners, said tabs passing through said slots and being folded down and stuck onto the top surface of the central panel with the second lateral panels being stuck onto the external surface of said flaps;
- the end flaps are stuck to the second lateral panels, the tabs being folded onto and stuck to the top surface of the central panel;
- the lid is removable;
- the first and/or second lateral panels are stuck to the adjacent lateral faces of the half-case. In such an instance, the products are placed in the half-case before the lid is stuck down;
- the first cutout comprises a series of at least four main walls joined together by first joining lines ending in a fixing tab, said series being connected on one side by a second joining line to a series of flaps forming the underside of said bottom, two of said flaps each comprising at least one lateral edge equipped with a notch able to form said recesses;
- the first cutout comprises a series of three walls joined together by third joining lines equipped on each side, via fourth and fifth joining lines respectively, with a first and a second series of flaps, and in that the central wall of said series of walls is equipped with at least two recesses;
- each of said recesses is situated on the edge of a joining line with a flap adjacent to said central wall;
- the recesses are situated on the edge or in the vicinity of the first joining lines with each of the walls adjacent to the central wall;
- the underside of the bottom comprises four recesses arranged substantially at the four corners of the case, the lid comprising four corresponding tabs on its top surface.

The invention also proposes a set of cutouts that can be used to obtain such a case.

It also and notably proposes a set of cutouts made of corrugated card sheet material, or equivalent intended to form a case, namely a first cutout able to form the bottom of the case and a second cutout able to form the lid of said case, said first cutout comprising recesses and said second cutout comprising a rectangular central panel equipped on each side with a rectangular lateral panel, namely two first opposite lateral panels connected to said central panel by first fold lines and two second opposite lateral panels connected to said central panel by second fold lines, characterized in that the two first opposite lateral panels are respectively connected along each of their lateral sides to end flaps by third fold lines to form reinforced corners, and in that at least two end flaps are connected to a stick-down tab by a fourth fold line perpendicular to the third fold line of the corresponding flap, said tabs being directed toward said second lateral panels when the second cutout is laid out flat, and able to be stuck to the top surface of the lid when it is made up in line with the complementary shaped recesses.

Advantageously, the central panel comprises slots through which the tabs can pass in the second fold lines between the central panel and the second lateral panels, said tabs being able to pass through said slots and be folded down onto and stuck to the top surface of the central panel.

In another advantageous embodiment, the lateral edges of the second lateral panels have notches.

Again advantageously, the notches are of a shape that complements that of the tabs.

Advantageously, the second cutout has four tabs.

In another advantageous embodiment, the first cutout comprises a series of at least four main walls joined together by first joining lines ending in a fixing tab, said series being connected on one side by a second joining line to a series of flaps forming the underside of said bottom, two of said flaps each comprising at least one lateral edge equipped with a notch able to form said recesses.

The invention also proposes a method for creating a packing case from a set of two cutouts of cardboard or corrugated cardboard in sheet form, as described hereinabove, in which the lid is formed by pressing down onto the top surface the tabs that have been previously coated with hot-melt adhesive.

In one advantageous embodiment, with the central panel equipped with slots at the joining lines where it meets the lateral panels, the lateral panels equipped with flaps are prefolded, the flaps are prefolded, the tabs then directed vertically are posted into the slots, then the lateral panels with no flaps are pressed down and the tabs are coated with adhesive and pressed down onto the top surface.

In another advantageous embodiment, the first and second lateral panels are folded and, once the internal faces of the flaps have been coated with adhesive, the flaps are pressed down and, finally, the tabs are pressed down onto the top surface.

Advantageously, once the panels, flaps and tabs have been coated with adhesive, the lateral panels are pressed down onto the lateral surfaces of the half-case before the flaps and tabs are pressed down onto the top surface of the lid.

The present invention will be better understood from reading the following description of some embodiments which are given hereinafter by way of nonlimiting examples.

The description refers to the accompanying drawings in which:

FIGS. 1 and 2 show a set of cutouts for constructing a packing case in corrugated cardboard for example 2 to 3 mm thick, comprising two cutouts.

Figure 1:
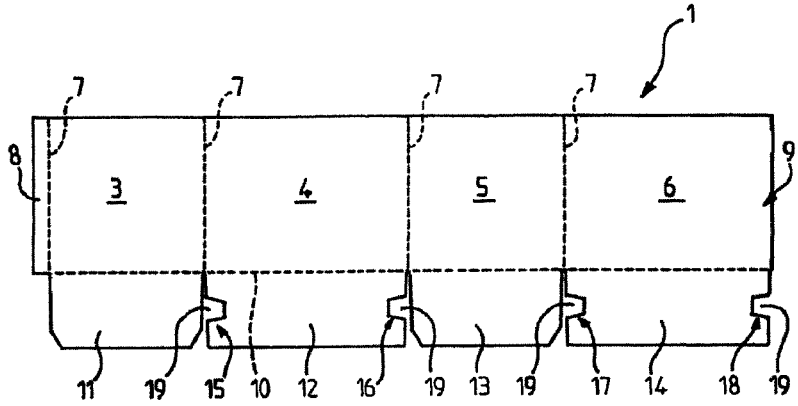
FIG. 1 is a plan view from above of a first cutout according to a first embodiment of the invention.

A first cutout 1 able to form the bottom of the case and a second cutout 2 for forming the lid of the case.

The first cutout comprises a series of four rectangular main walls 3, 4, 5, 6 joined together by first joining lines 7 which are mutually parallel and ending in a fixing tab 8, likewise rectangular, for sticking the tab onto the external periphery 9 of the wall opposite when the half-case is being formed.

The series of walls is connected along one side by a second joining line 10 perpendicular to the lines 7, to a series of substantially rectangular flaps 11, 12, 13, 14, two of said opposite flaps 12 and 14 having, on their respective lateral edges 15, 16, 17, 18, notches able to form recesses when the bottom of the half-case is formed.

More specifically, these notches are, for example, of substantially trapezoidal shape or have an outline in the form of a portion of a circle or of an oval that complements that of the tabs that will be described hereinafter, for example situated on the flap at the half-way point over one third of its height.

The other two flaps 11, 13 are free of any notches in their sides.

Finally, the other side of the series of walls has no flaps.

Figure 2:
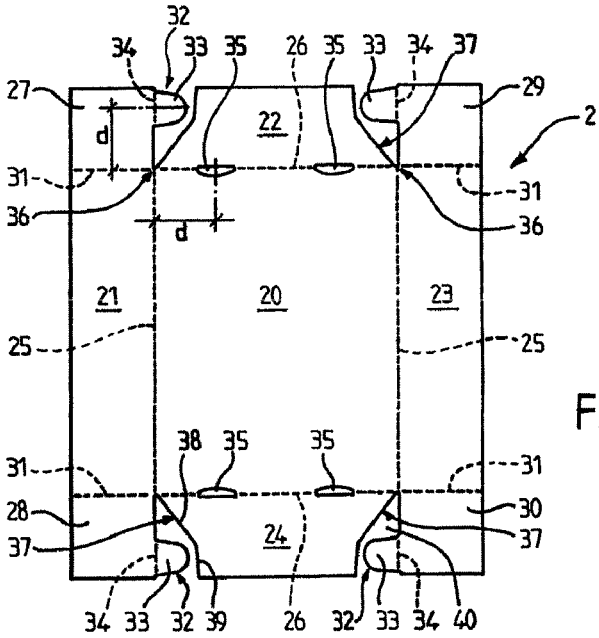
FIG. 2 is a plan view from above of a second cutout according to a first embodiment of the invention.

FIG. 2 for its part shows the second cutout 2 used to form the lid of the case.

The second cutout comprises a rectangular central panel equipped on each side with a rectangular lateral panel 21, 22, 23, 24, namely two first opposite lateral panels 21, 23 connected to the central panel by first fold lines 25 and two second opposite lateral panels 22 and 24 connected to said central panel by second fold lines 26 which are perpendicular to the first fold lines.

The two first opposite lateral panels 21 and 23 are respectively connected along each of their lateral sides to respective rectangular end flaps 27, 28 and 29, 30 by third fold lines 31 in the continuation of the second fold lines 26, in order to form reinforced corners.

Each of these four end flaps 27, 28, 29, 30 comprises, on its lateral edge 32 which, when the second cutout is laid out flat, is directed toward the adjacent flap, a stick-down tab 33, via a fourth fold line 34 perpendicular to the third fold line 31 of the corresponding flap.

The tabs 33 can be stuck down onto the top surface of the lid when it is formed, in line with the recesses and of a shape that complements that of the latter, to allow the ones to fit into the others, as described with reference to the cutout 1.

The central panel 20 comprises slots 35 through which the tabs can pass, on the second fold lines 26 between the central panel 20 and the second lateral panels 23, 24 and which are situated a distance d from the corner of the central panel. The tabs are themselves located at the same distance d, and are of a width and thickness slightly smaller than those of the slots so that they can pass through the latter and be folded down and stuck onto the top surface of the central panel.

To do this, and in an embodiment that makes the folding-down easier, the fold line 34 is offset slightly toward the outside of the tab, for example by half the thickness of the corrugated board, or by one thickness thereof.

The second opposite panels 22 and 24 are, for their part, free of any lateral flaps and have a shape on their lateral sides 37 facing toward the tabs 33, this shape for example being that of a rectangular trapezium, the flap comprising a first part 38 angled toward the inside of the packaging from the second fold line 26, and a second part 39 which for example is parallel to the fourth fold lines 34 so that when the cut-out blank or cutout is laid out flat, there is a space 37' providing good clearance to the corresponding tab.

The slots 35 situated on the second fold lines corresponding to the second panels indicated hereinabove number, for example, four (two per line) each being positioned substantially one quarter of the way along said line at each end thereof.

The creation of a packing case 40 from the cutouts described with reference to FIGS. 1 and 2 will now be described with reference to FIGS. 3A to 3D. In the remainder of the description, the same reference numerals will be used to denote the same elements.

Figures 3A, 3B, 3C, 3D:
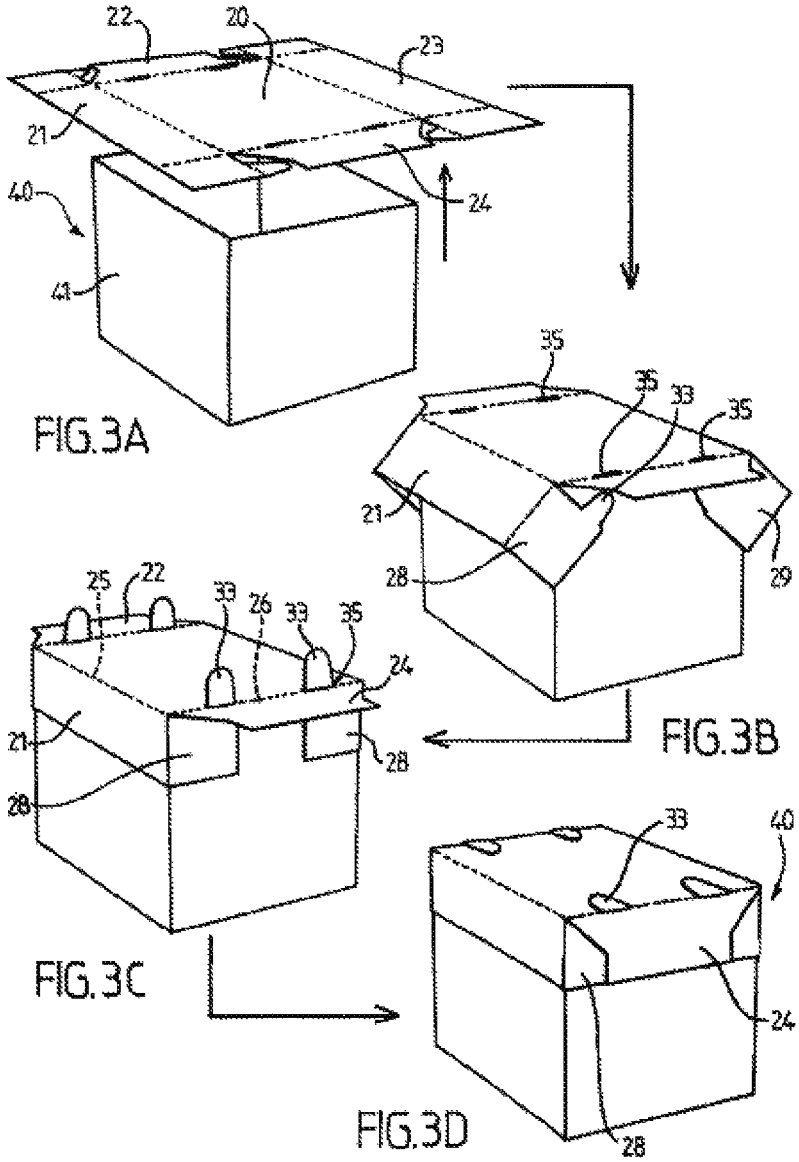
FIGS. 3A to 3D are perspective views of the creation on a half-case of a lid from the second cutout of FIG. 2.

In FIG. 3A, the central panel is brought, flat, to face the half-case 41 already formed, for example, around a former by folding the walls of the first cutout 1 and positioning and closing the flaps to construct the bottom of said half-case.

The flaps comprising the recesses (which are not visible in the figures) are then stuck down onto the flaps that do not have recesses, to form the notches or recesses in the bottom of the box, which are going to collaborate with the tabs.

With reference to FIG. 3B, the lateral panels 21 and 23 that are equipped with the flaps 27, 28, 29, 30 are prefolded then the flaps are prefolded; the tabs 23 which are then standing vertically in the continuation of the plane of the flaps are posted into the slots 35, then the lateral panels 22, 24 which do not have flaps and which have been coated with adhesive beforehand are pressed down onto said flaps 28, then the internal surfaces of the tabs are coated with adhesive and pressed down onto the top surface of the central panel to form the lid, then the case 40 as can be seen in FIG. 3D.

Figure 4:
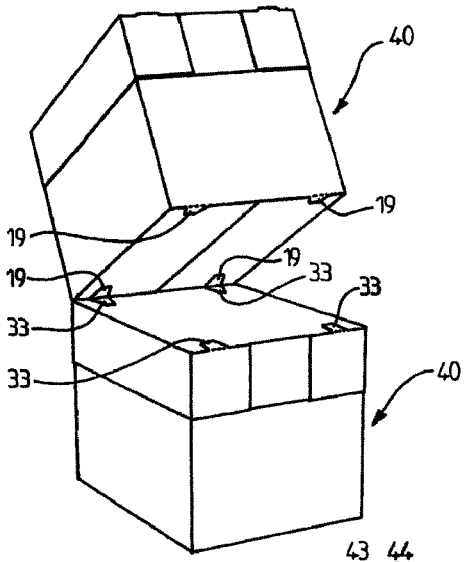
FIG. 4 is a perspective view showing the interlocking of two cases obtained from first and second cutouts according to embodiments of the invention.

FIG. 4 depicts two cases 40 as described hereinabove, being superposed, showing how the tabs 33 fit into the recesses 19 opposite belonging to the case above.

Such fitting-together will provide excellent stability between the boxes and do so in a simple way.

Figure 5:
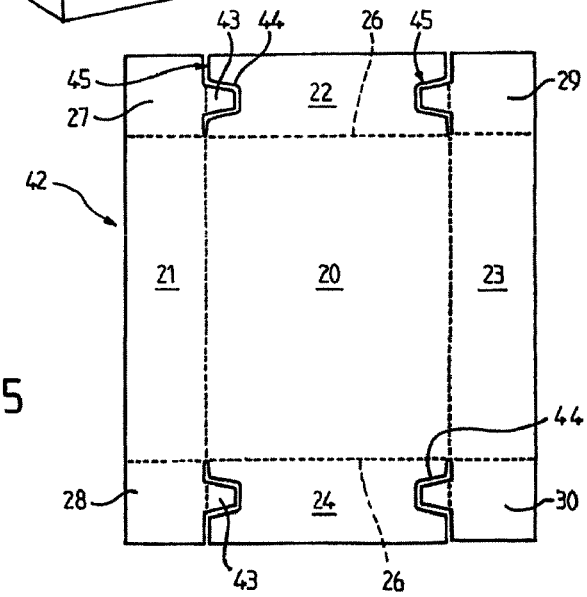
FIG. 5 is a plan view from above of a second cutout according to a second embodiment of the invention.

FIG. 5 depicts another embodiment of a second cutout 42 according to the invention.

This is a cutout consisting of a central panel 20 equipped on each of its sides with lateral panels 21, 22, 23, 24, two of the lateral panels 21 and 23 of which have flaps 27, 28, 29, 30 which are themselves equipped with tabs 43, for example designed to espouse the shape of the lateral edges 44 of the adjacent lateral wall 22, 24, leaving a small slot 45 around them, for example measuring 2 mm wide, to permit good clearance of the tab in relation to the adjacent board.

Such a lid will here permit a different embodiment, the make-up of which is described with reference to FIGS. 6A to 6D.

Figure 6A:
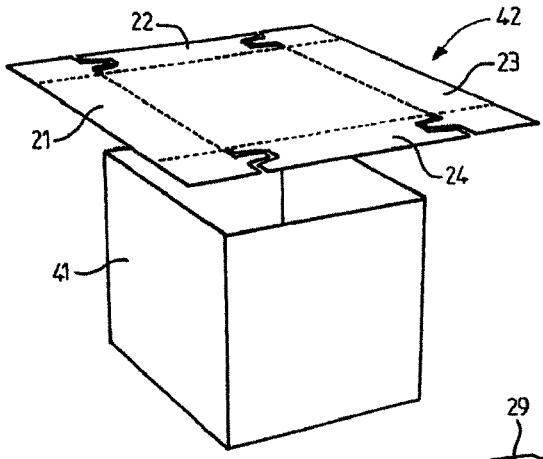
FIGS. 6A to 6D are perspective views of the creation on a half-case of a lid from the second cutout of FIG. 5.
Figure 6B:
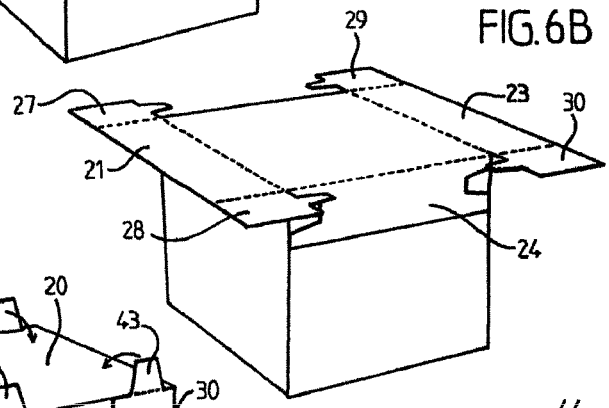
Figure 6C:
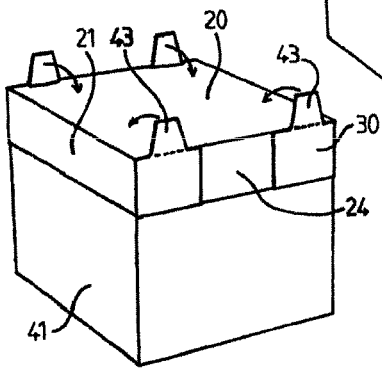

The objective here is no longer that of posting the tabs 43 through slots but simply of giving the second cutout 42 the lid shape described with reference to FIG. 5 on the half-case 41, as indicated in FIG. 6A, once the internal surfaces of the flaps 27, 28, 29, 30 and of the tabs 43 have been stuck down.

Figure 6D:
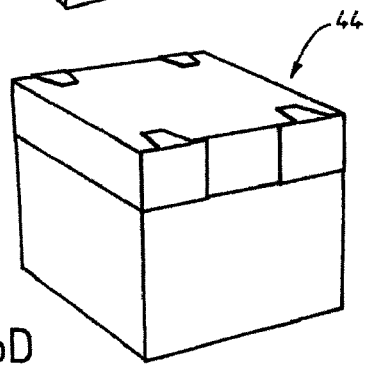

To do this, the second panels 22 and 24 are, for example, folded down (FIG. 6B) and pressed onto the facing lateral faces of the half-case 41, before the first lateral panels 21 and 23 are, in their turn, folded down and pressed onto the facing adjacent sides, then the flaps 27, 28, 29, 30 are folded and pressed down (see FIG. 6C) before finally the adhesive-coated tabs 43 are pressed down onto the top surface of the panel 20 of the case, in order to obtain the lid and therefore the packaging 44 that is shown in FIG. 6D.

Figure 7A:
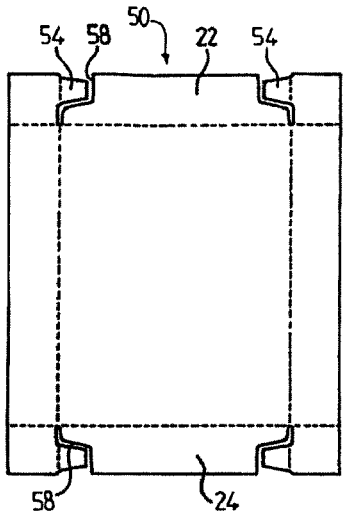
FIGS. 7A, 7B and 8A, 8B are plan views from above of other embodiments of final cutouts according to the invention with four tabs.
Figure 7B:
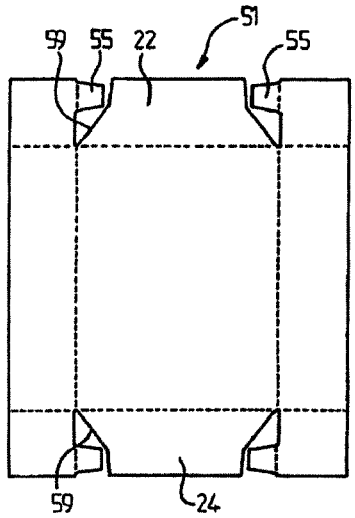

FIGS. 7A and 7B then 8A and 8B show embodiments of second cutouts according to the invention 50, 51, 52, 53, each of the cutouts comprising four tabs of different types, namely (FIGS. 7A and 7B) tabs 54, 55, 56, 57 attached to flaps, directed toward the small panels 22, 24, with opposing notches 58, 59 either corresponding to the shapes of the tabs (notch 58 in FIG. 7A) or corresponding to half a trapezium leaving the opposing tab free (notch 59 in FIG. 7B).

Figure 8A:
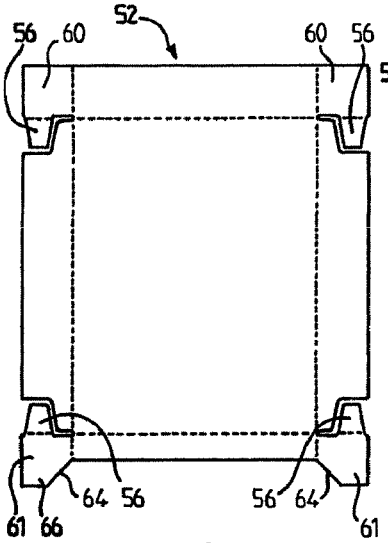
Figure 8B:
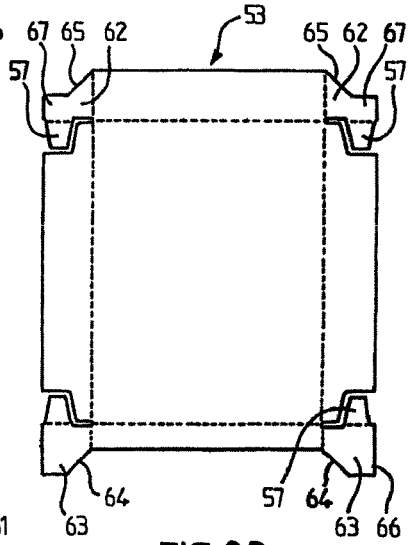

The second embodiment of cutouts corresponding to FIGS. 8A, 8B this time shows exemplary embodiments with flaps 60, 61, 62, 63 on the small panels which have external edge heights that are either equal or different (flap 60), smaller (flap 62) or larger (flaps 61, 63) with respect to the height of said second panel and which, in the latter instances, have dog legs for example with an external edge angled toward the outside 64 or toward the inside 65 of the cutout with respect to the external periphery of the panel to which the flap is attached before reverting to a rectangular shape.

Figures 9, 10A, 10B, 11:
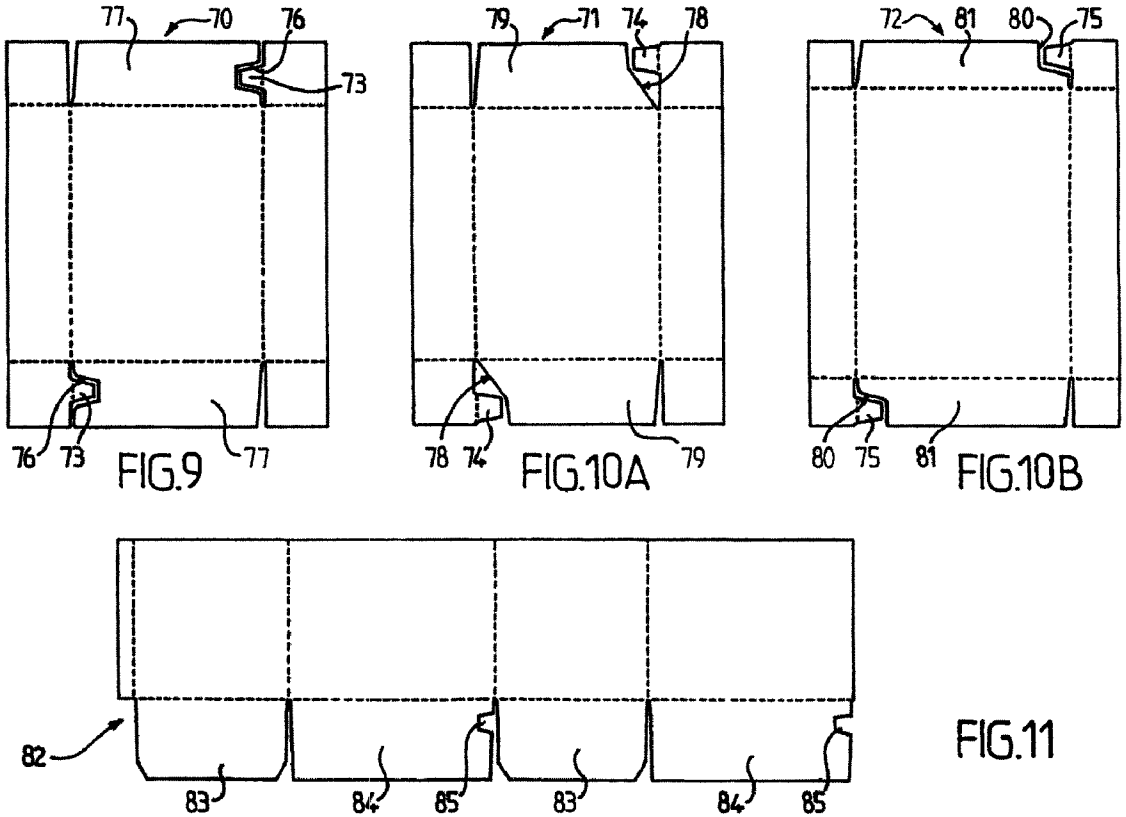
FIGS. 9, 10A and 10B are plan views from above of other embodiments of second cutouts according to the invention, with two tabs.
FIG. 11 is a plan view of one embodiment of a first cutout with two recesses, arranged to collaborate with two corresponding first cutout tabs.

FIGS. 9, 10A and 10B show other embodiments of second cutouts 70, 71, 72 having just two tabs on two external flaps on a diagonal, with either a notch 76 in the adjacent panel 77 surrounding the tab, or a notch 78 in the form of half a trapezium in the adjacent panel 79, or a notch 80 open to the outside and of a shape that complements that of the tab in the lateral panel 81.

The panels 77, 79 or 81 also have another lateral edge that is straight facing the flaps that have no tab.

The corresponding first cutout 82 (cf. FIG. 11) comprises, like the cutout described with reference to FIG. 1, flaps 83, 84 that form the bottom which, this time, are equipped, in the case of two opposing flaps 84, with just one notch 85, on their lateral sides, able to collaborate with the tab when the packaging is formed.

Figure 12:
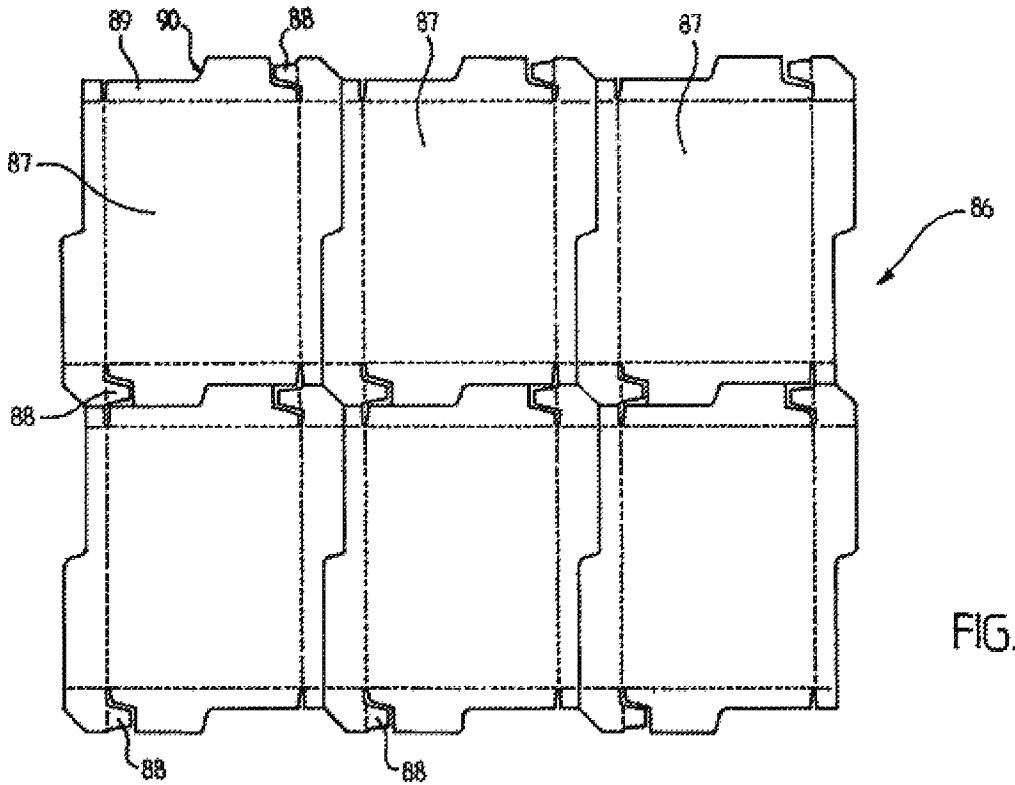
FIG. 12 is a plan view of a second cutouts arrangement, these second cutouts being imbricated with one another according to one embodiment of the invention that optimizes the use of the board.

FIG. 12 depicts a panel 86 or width of corrugated board that optimizes the use of the board for second cutouts 87, designed with complementary shapes in order to obtain lids according to the invention, here with two diagonally opposite tabs 88.

In these embodiments, the second lateral panels 89 comprise dog legs 90 on their upper edge.

Figure 13:
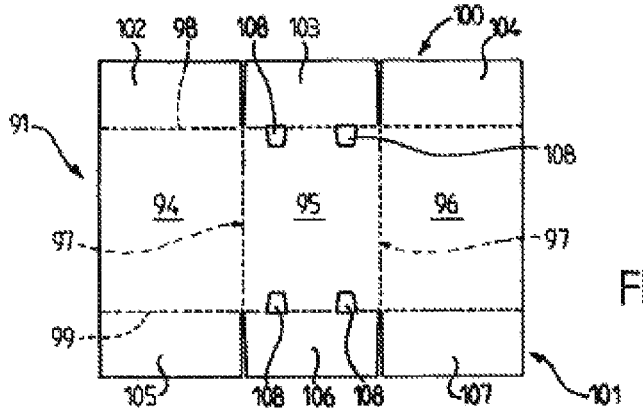
FIGS. 13, 14 and 15 show embodiments of the first cutout, according to the invention, with three walls.
Figure 14:
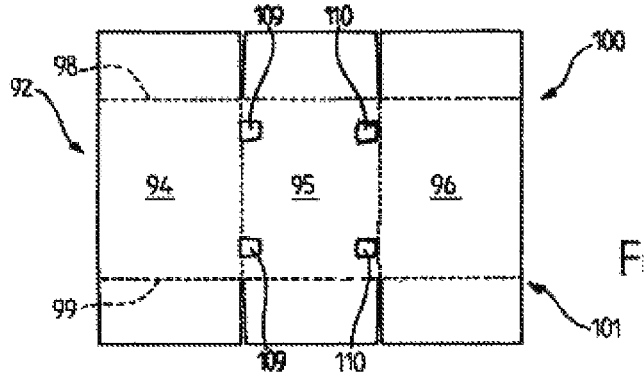
Figure 15:
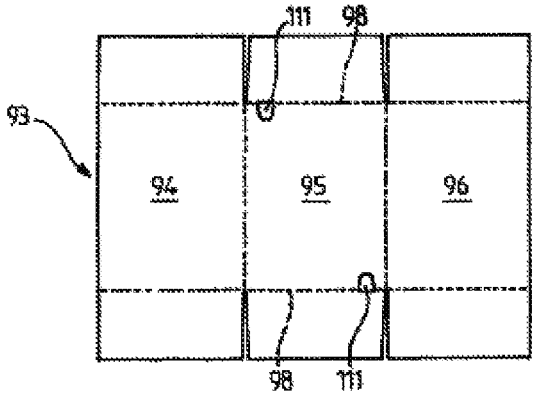

Finally, FIGS. 13, 14 and 15 show other embodiments of first cutouts 91, 92, 93 according to the invention.

Here, each first cutout comprises a series of three walls 94, 95, 96, joined together by parallel third joining lines and are equipped at each end and respectively via a fourth 98 and a fifth 99 mutually parallel joining lines, with a first 100 and a second 101 series of substantially rectangular flaps, namely three flaps 102, 103, 104 and 105, 106, 107.

In the embodiment of FIG. 13, the central wall 95 comprises, on its fourth and fifth lines 98, 99 with the flaps 103 and 106 for joining, two rectangular or substantially rectangular elements 108 at each end and facing one another, namely four recesses in total.

In the embodiment of FIG. 14, the recesses here are situated in pairs, on the edge 109 or in the vicinity 110 of a first joining line 97 for joining with each of the adjacent flaps 94, 95, here too of substantially rectangular shape corresponding to the tab.

Finally, FIG. 15 depicts another embodiment of a first cutout 93 according to the invention, in which the underside of the central wall 95 has just two recesses 11 which are identical or of the type of the recesses 105, arranged on a diagonal on the central wall at the joining lines 98 and able this time to collaborate with tabs of the type described for the second cutouts with reference to FIGS. 9, 10A, 10B and 12.

As goes without saying and as is in any case evident from the foregoing, the present invention is not restricted to the embodiments more particularly described. On the contrary, it encompasses all variants thereof particularly those in which the shape of the tabs is different.

The invention claimed is:

1. A packing case comprising a bottom forming a half-case obtained from a first cutout and a lid formed by a second cutout, an underside of the bottom being equipped with recesses and the lid comprising at least two tabs which are stuck to a top surface thereof, in line with the recesses of complementary shape, wherein the lid comprises a central panel equipped on its sides with four lateral panels two of which are equipped with end flaps, said at least two tabs each being connected to one of said end flaps and wherein the first cutout comprises a series of at least four main walls joined together by first joining lines ending in a fixing tab, said series being connected on one side by a second joining line to a series of flaps forming the underside of said bottom, two of said series of flaps each comprising at least one lateral edge equipped with a notch able to form said recesses.

2. The packing case as claimed in claim 1, wherein the four lateral panels comprise:

two first opposite lateral panels which are connected to said central panel by first fold lines with, at each end, said end flaps forming reinforced corners which are connected to said first opposite lateral panels by third fold lines, the at least two tabs being connected respectively to a top edge of corresponding flaps by fourth fold lines, and, two second opposite lateral panels which are connected to said central panel by second fold lines which are free of one or more end flaps.

3. The packing case as claimed in claim 2, wherein the central panel comprises slots through which the at least two tabs can pass in the second fold lines between the central panel and the second opposite lateral panels, in that said first opposite lateral panels are folded over downward to collaborate with lateral faces of the half-case, said series of flaps being folded down onto corresponding corners, said at least two tabs passing through said slots and being folded down and stuck onto a top surface of the central panel with the second opposite lateral panels being stuck onto external surface of said series of flaps.

4. The packing case as claimed in claim 2, wherein the end flaps are stuck to the second opposite lateral panels, the at least two tabs being folded onto and stuck to a top surface of the central panel.

5. The packing case as claimed in claim 1, wherein the lid is removable.

6. The packing case as claimed in claim 1, wherein at least one of the first or second opposite lateral panels are stuck to adjacent lateral faces of the half-case.

7. The packing case as claimed in claim 1, wherein the underside of the bottom comprises four recesses arranged substantially at the four corners of the packing case, and wherein the lid comprises four corresponding tabs on its top surface.

8. A set of cutouts for constructing a packing case, comprising two cutouts made of corrugated card sheet material, namely a first cutout able to form a bottom of the packing case and a second cutout able to form a lid of said packing case, said first cutout comprising recesses and said second cutout comprising a rectangular central panel equipped on each side with a rectangular lateral panel, namely two first opposite lateral panels connected to said rectangular central panel by first fold lines and two second opposite lateral panels connected to said rectangular central panel by second fold lines, wherein the two first opposite lateral panels are respectively connected along each of their lateral sides to end flaps by third fold lines to form reinforced corners, and wherein at least two of said end flaps are connected to a stick-down tab by a fourth fold line perpendicular to at least one of the third lines, wherein tabs are directed toward said second opposite lateral panels when the second cutout is laid out flat, and able to be stuck to a top surface of the lid when it is made up in line with complementary shaped recesses and wherein the first cutout comprises a series of at least four main walls joined together by first joining lines ending in a fixing tab, said series of at least four main walls being connected on one side by a second joining line to a series of flaps forming an underside of said bottom, two of said series of flaps each comprising at least one lateral edge equipped with a notch able to form said recesses.

9. The set of cutouts as claimed in claim 8, wherein the rectangular central panel comprises slots through which the tabs can pass in the second fold lines between the central panel and the second opposite lateral panels arranged, said tabs being able to pass through said slots and be folded down onto and stuck to a top surface of the central panel.

10. The set of cutouts as claimed in claim 8, wherein lateral edges of the second opposite lateral panels have notches.

11. The set of cutouts as claimed in claim 10, wherein the notches are of a shape that complements that of the tabs.

12. The set of cutouts as claimed in claim 8, wherein the second cutout has four tabs.

13. The set of cutouts as claimed in claim 8, wherein the underside of the bottom comprises four recesses arranged substantially at four corners of said underside.

14. The method as claimed in claim 13, wherein the central panel is equipped with slots at joining lines where it meets lateral panels, at least one of the lateral panels are equipped with flaps that are prefolded, at least one other of the lateral flaps is with no flaps, the series of flaps are prefolded, and wherein the method further comprises: directing the tabs vertically such that the tabs are posted into the slots, pressing down on said at least one other of the lateral panels, and pressing down on the tabs, which are coated with the hot-melt adhesive.

15. A method for creating a packing case from at least two cutouts of cardboard or corrugated cardboard in sheet form, as claimed in claim 8, wherein the method comprises: forming the lid by pressing down onto the top surface of the lid, wherein the tabs have been previously coated with hot-melt adhesive.

16. The method as claimed in claim 15, wherein the first and second opposite lateral panels are folded and the method further comprises once internal faces of the series of flaps have been coated with adhesive, pressing down on the flaps and, pressing down the tabs onto the top surface of the lid.

17. The method as claimed in claim 16, further comprising: once the series of flaps and the tabs have been coated with adhesive, pressing down the lateral panels onto lateral surfaces of the half-case before the series of flaps and the tabs are pressed down onto the top surface of the lid.

* * * * *

UNITED STATES PATENT AND TRADEMARK OFFICE

CERTIFICATE OF CORRECTION

PATENT NO. : 8,590,772 B2
APPLICATION NO. : 12/810582
DATED : November 26, 2013
INVENTOR(S) : Delause et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 552 days.

Signed and Sealed this
Twenty-second Day of September, 2015

Michelle K. Lee

Michelle K. Lee
*Director of the United States Patent and Trademark Office*